US010290940B2

(12) United States Patent
Toh et al.

(10) Patent No.: US 10,290,940 B2
(45) Date of Patent: May 14, 2019

(54) BROADBAND SWITCHABLE ANTENNA

(71) Applicant: FutureWei Technologies, Inc., Plano, TX (US)

(72) Inventors: Wee Kian Toh, San Diego, CA (US); Ping Shi, San Diego, CA (US)

(73) Assignee: Futurewei Technologies, Inc., Plano, TX (US)

( * ) Notice: Subject to any disclaimer, the term of this patent is extended or adjusted under 35 U.S.C. 154(b) by 122 days.

(21) Appl. No.: 14/219,292

(22) Filed: Mar. 19, 2014

(65) Prior Publication Data

US 2015/0270613 A1 Sep. 24, 2015

(51) Int. Cl.

| | |
|---|---|
| ***H01Q 9/04*** | (2006.01) |
| ***H01Q 5/30*** | (2015.01) |
| ***H01Q 5/328*** | (2015.01) |
| ***H01Q 5/357*** | (2015.01) |
| ***H01Q 5/307*** | (2015.01) |
| ***H01Q 5/364*** | (2015.01) |
| ***H01Q 5/371*** | (2015.01) |

(Continued)

(52) U.S. Cl.

CPC ..... *H01Q 5/30* (2015.01); *H01Q 1/243* (2013.01); *H01Q 5/307* (2015.01); *H01Q 5/314* (2015.01); *H01Q 5/328* (2015.01); *H01Q 5/357* (2015.01); *H01Q 5/364* (2015.01); *H01Q 5/371* (2015.01); *H01Q 9/0421* (2013.01); *H01Q 9/0442* (2013.01); *H01Q 9/42* (2013.01)

(58) Field of Classification Search

CPC ..... H01Q 5/328; H01Q 5/364; H01Q 5/314; H01Q 5/307; H01Q 5/357; H01Q 5/371; H01Q 9/0442

USPC ..... 343/772, 846, 724, 876

See application file for complete search history.

(56) References Cited

U.S. PATENT DOCUMENTS 7,420,513 B2 * 9/2008 Tsutsumi ..... H01Q 9/0428 343/700 MS 8,217,841 B2 * 7/2012 Hossain ..... H01Q 1/243 343/700 MS (Continued)

OTHER PUBLICATIONS

Komulainen, M. et al, "A Frequency Tuning Method for a Planar Inverted-F Antenna," IEEE Transactions on Antennas and Propagation, vol. 56, No. 4, Apr. 2008, pp. 944-950.

(Continued)

*Primary Examiner* — Dameon E Levi

*Assistant Examiner* — Ab Salam Alkassim, Jr.

(74) *Attorney, Agent, or Firm* — Jinghua Karen Tang

(57) ABSTRACT

System and method embodiments are provided for a broadband switchable antenna. The embodiments enable an easily tunable, temporally switchable antenna with good low- and high-band performance with controlled high impedance loci that easily coexists with other wireless device components. In an embodiment, a broadband switchable antenna includes an antenna feed; a high-band antenna arm comprising a first end electrically coupled to an antenna feed and a second end electrically coupled to ground; a switch coupled to the antenna feed at a position proximate to the first end of the high-band antenna arm; and a low-band antenna arm comprising a first end electrically coupled to the switch, wherein the antenna is configured to operate in a high-band mode when the switch is open and to operate in a low-band mode when the switch is closed.

19 Claims, 12 Drawing Sheets

(51) Int. Cl.

| | |
|---|---|
| ***H01Q 5/314*** | (2015.01) |
| ***H01Q 1/24*** | (2006.01) |
| ***H01Q 9/42*** | (2006.01) |

(56) References Cited

U.S. PATENT DOCUMENTS 9,088,067 B2 * 7/2015 Wong ..... H01Q 1/243
9,406,999 B2 * 8/2016 Rappoport ..... H01Q 1/243
2003/0151555 A1 * 8/2003 Holshouser ..... H01Q 1/243 343/700 MS
2004/0066287 A1 * 4/2004 Breed ..... B60C 23/0433 340/442
2004/0075614 A1 * 4/2004 Dakeya ..... H01Q 21/30 343/745
2005/0104694 A1 * 5/2005 Cho ..... H01H 50/005 335/78
2005/0174673 A1 * 8/2005 Price, Jr. ..... G11B 5/09 360/55
2005/0231434 A1 * 10/2005 Azadegan ..... H01Q 13/10 343/767
2006/0097918 A1 * 5/2006 Oshiyama ..... H01Q 1/243 343/700 MS
2006/0262015 A1 * 11/2006 Thornell-Pers ..... H01Q 1/243 343/702
2007/0035458 A1 * 2/2007 Ohba ..... H01Q 1/243 343/702
2007/0057849 A1 * 3/2007 Moon ..... H01Q 9/42 343/700 MS
2007/0069956 A1 * 3/2007 Ozkar ..... H01Q 5/00 343/700 MS
2007/0224949 A1 * 9/2007 Morton ..... H01Q 3/247 455/101
2007/0268191 A1 * 11/2007 Ishizuka ..... H01Q 1/243 343/702
2008/0150808 A1 * 6/2008 Asrani ..... H01Q 9/0421 343/702
2008/0211729 A1 * 9/2008 Eriksson ..... H01P 1/127 343/876
2009/0073078 A1 * 3/2009 Ahn ..... H03K 17/063 343/876
2009/0128428 A1 * 5/2009 Ishizuka ..... H01Q 1/243 343/702
2009/0167617 A1 * 7/2009 Nishio ..... H01Q 9/0421 343/702
2010/0033397 A1 * 2/2010 Narasimhan ..... H01Q 1/38 343/860
2010/0164812 A1 * 7/2010 Ganeshan ..... H01Q 9/36 343/702
2010/0245201 A1 * 9/2010 Hossain ..... H01Q 1/243 343/848
2011/0128200 A1 * 6/2011 Hossain ..... H01Q 7/00 343/745
2012/0127055 A1 * 5/2012 Yamagajo ..... H01Q 1/243 343/850
2012/0169567 A1 * 7/2012 Kim ..... H01Q 1/241 343/876
2012/0287014 A1 * 11/2012 Tseng ..... H01Q 1/243 343/876
2013/0076574 A1 * 3/2013 Rappoport ..... H01Q 1/243 343/702
2013/0099996 A1 * 4/2013 Tseng ..... H01Q 1/243 343/876
2013/0169490 A1 * 7/2013 Pascolini ..... H01Q 5/357 343/702
2013/0176189 A1 * 7/2013 Kodama ..... H01Q 1/243 343/876
2013/0194158 A1 * 8/2013 Chen ..... H01L 27/0251 343/876
2013/0201067 A1 * 8/2013 Hu ..... H01Q 1/243 343/745
2013/0234897 A1 * 9/2013 Yoon ..... H01Q 19/00 343/700 MS
2013/0241795 A1 * 9/2013 Sung ..... H01Q 1/50 343/861
2013/0241798 A1 * 9/2013 Lee ..... H01Q 1/50 343/876
2013/0249765 A1 * 9/2013 Su ..... H01Q 1/243 343/850
2013/0257679 A1 * 10/2013 Wong ..... H01Q 1/243 343/876
2013/0307733 A1 * 11/2013 Chiu ..... H01Q 9/16 343/700 MS
2014/0104128 A1 * 4/2014 Pu ..... H01Q 3/247 343/848
2014/0104134 A1 * 4/2014 Chen ..... H01Q 1/243 343/876
2014/0128007 A1 * 5/2014 Chen ..... H04B 1/18 455/77
2014/0132469 A1 * 5/2014 Wang ..... H01Q 1/2266 343/821
2014/0159982 A1 * 6/2014 De Luis ..... H01Q 5/10 343/843
2014/0253398 A1 * 9/2014 Hsieh ..... H01Q 5/328 343/745
2014/0266968 A1 * 9/2014 Wong ..... H01Q 5/35 343/876
2014/0306855 A1 * 10/2014 Tsai ..... H01Q 5/314 343/745
2014/0306859 A1 * 10/2014 Desclos ..... H01Q 1/50 343/822
2014/0320376 A1 * 10/2014 Ozdemir ..... H01Q 9/0442 343/876
2014/0354508 A1 * 12/2014 Lee ..... H01Q 1/48 343/860
2014/0375515 A1 * 12/2014 Qiu ..... H01Q 1/243 343/745
2015/0002348 A1 * 1/2015 Wong ..... H01Q 1/243 343/724
2015/0015445 A1 * 1/2015 Sanchez ..... H01Q 5/328 343/724
2015/0054697 A1 * 2/2015 Chen ..... H01Q 1/50 343/745
2015/0123855 A1 * 5/2015 Ryu ..... H01Q 5/328 343/702
2015/0145744 A1 * 5/2015 Kao ..... H01O 9/0421 343/852
2015/0180118 A1 * 6/2015 Huang ..... H01Q 1/526 343/841
2015/0188224 A1 * 7/2015 Chang ..... H01Q 1/243 343/724
2015/0222020 A1 * 8/2015 Tai ..... H01Q 1/243 343/745
2015/0236417 A1 * 8/2015 Iellci ..... H01Q 1/243 343/850
2015/0236671 A1 * 8/2015 Smith ..... H03H 7/01 327/553
2015/0270613 A1 * 9/2015 Toh ..... H01Q 9/0442 343/876
2016/0043468 A1 * 2/2016 Onaka ..... H03H 7/40 343/750
2016/0056545 A1 * 2/2016 Park ..... H01Q 1/243 343/702
2016/0254590 A1 * 9/2016 Seo ..... H04B 1/006 343/876
2016/0276742 A1 * 9/2016 Yu ..... H01Q 1/48
2017/0012347 A1 * 1/2017 Ohguchi ..... H01Q 1/44
2017/0338560 A1 * 11/2017 Li ..... H04B 1/18
2017/0358838 A1 * 12/2017 Huang ..... H04W 4/70
2018/0342800 A1 * 11/2018 Nishizaka ..... H01Q 1/525

OTHER PUBLICATIONS

Li, Y. et al., "A Switchable Matching Circuit for Compact Wideband Antenna Designs," IEEE Transactions on Antennas and Propogation, vol. 58, No. 11, Nov. 2010, pp. 3450-3457.

* cited by examiner

BROADBAND SWITCHABLE ANTENNA

TECHNICAL FIELD

The present invention relates to antennas, and, in particular embodiments, broadband switchable antennas.

BACKGROUND

As more features are added to or improved upon for wireless devices, these wireless devices are increasingly required to support more frequency bands, e.g., data/voice services, carrier aggregation, roaming, etc. Broadband antenna technology, such as, for example, Long Term Evolution (LTE) B17, is required. Due to the limited space, passive cellular antenna design is a balance between high-band and low-band performance, according to different carrier requirements, e.g., high-band for carrier and low-band for a different carrier. Industrial designs (IDs) of wireless devices are gearing towards smaller/lower profiles with larger displays. Antennas with reduced keep-out area and lower profile have to coexist with other components, e.g., speaker, microphone, headphone jack, touch panel, flex circuit, Universal Serial Bus (USB), etc. These issues as well as increasing carrier and regulatory requirements (e.g., head and hand specification, Specific Absorption Rate (SAR), Electronic Communications Committee (ECC), etc.) create challenges that must be met by antenna designs for newer generations of wireless devices.

SUMMARY OF THE INVENTION

In accordance with an embodiment, a broadband switchable antenna includes an antenna feed; a high-band antenna arm comprising a first end electrically coupled to an antenna feed and a second end electrically coupled to ground; a switch coupled to the antenna feed a position proximate to the first end of the high-band antenna arm; and a low-band antenna arm comprising a first end electrically coupled to the switch, wherein the antenna is configured to operate in a high-band mode when the switch is open and to operate in a low-band mode when the switch is closed.

In accordance with another embodiment, a wireless device includes a processor; and an antenna structure coupled to the processor, wherein the antenna structure comprises: an antenna feed; a high-band antenna arm comprising a first end electrically coupled to an antenna feed and a second end electrically coupled to ground; a switch coupled to the antenna feed at a position proximate to the first end of the high-band antenna arm; and a low-band antenna arm comprising a first end electrically coupled to the switch, wherein the antenna is configured to operate in a high-band mode when the switch is open and to operate in a low-band mode when the switch is closed.

In accordance with another embodiment, an antenna includes a single antenna feed; a main antenna arm; multiple grounded coupling antenna arms coupling to multiple sections of the main antenna arm, and a switch comprising an open position and a short-circuited position, wherein the switch is coupled to the single antenna feed to control which of the main antenna arm and the multiple grounded coupling arms are coupled to the single antenna feed, wherein different resonating frequencies are tunable according to the position of the switch.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

Figure 1:
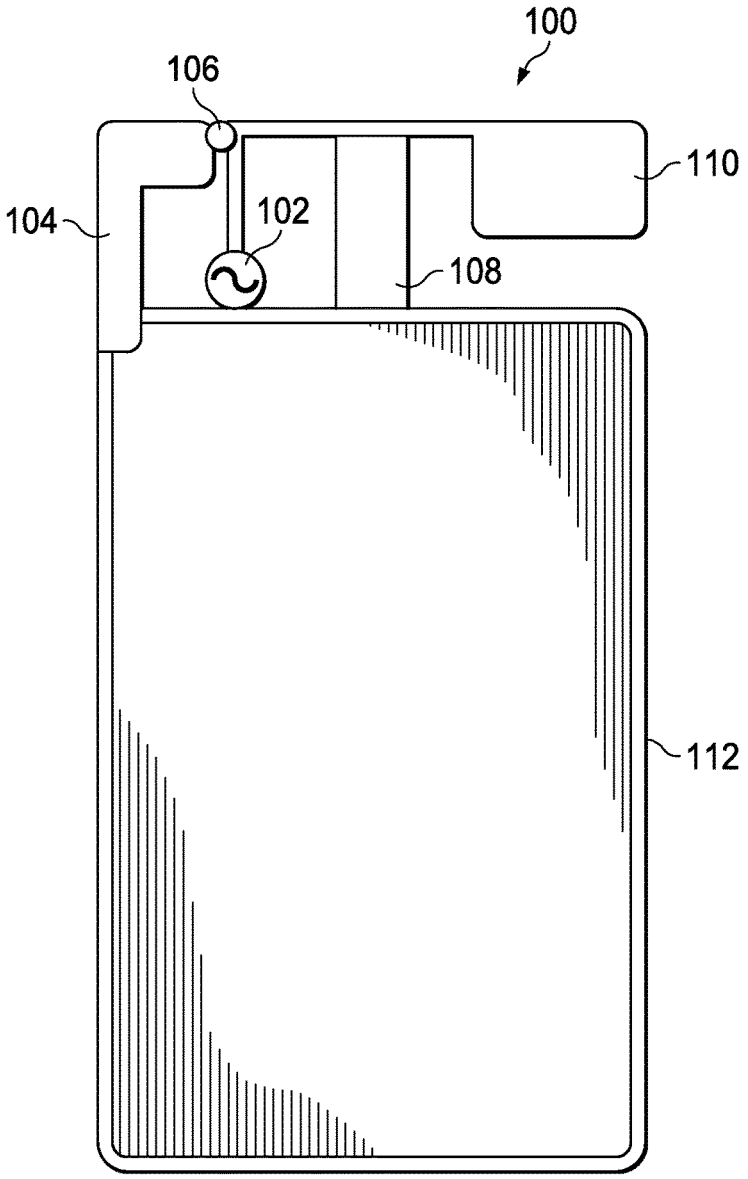
FIG. 1 is a schematic diagram of an embodiment wireless user equipment (UE) with a hybrid broadband switchable antenna.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Disclosed herein is a hybrid broadband switchable antenna. In an embodiment, the antenna includes a high-band antenna arm coupled to an antenna feed at one end and to ground at the other end. The antenna also includes a low-band antenna arm that is connected to the antenna feed by a switch at one end. The switch is located at or near the end of the high-band antenna arm that is connected to the antenna feed. The low-band antenna arm is connected to ground at the opposite end from the point at which the low-band antenna arm is connected to the switch. The low-band antenna arm may be segmented and include a gap of non-electrically conducting material between the two segments of the low-band antenna. The position of the switch controls whether the antenna is tuned for the low-band operation or for the high-band operation. In an embodiment, the switch is open for high-band operation and is closed for low-band operation. An open switch prevents current from flowing into the low-band antenna arm. The disclosed hybrid broadband switchable antenna may be considered a hybrid of an inverted-F antenna (IFA) and a loop antenna that provides many of the benefits of each without many of the problems associated with each. In an embodiment, temporal optimization for low-band or high-bands is provided. In an embodiment, the high-end (i.e., shorter) coupling antenna arm is connected to ground nearer to the antenna feed than the low-band (i.e., longer) coupling antenna arm.

In an embodiment, the hybrid broadband switchable antenna includes multiple high-band antenna arms, multiple low-band antenna arms, and multiple switches allowing the antenna to be tuned to multiple high-band resonances and multiple low-band resonances depending on the switch positions of the various switches. In an embodiment, one or more low-band antenna arms include a matching circuit for impedance matching.

The disclosed switchable broadband antenna provides good low-band and good high-band performance without sacrificing one band for the other. In an embodiment, the position of the high impedance loci is controlled thereby providing improved head and hand loading performance as compared to other antennas. The disclosed antenna co-exists with other components (e.g., speaker, microphone, center/side USB, etc.) without sacrificing performance of the antenna or effecting the performance of the other components. The disclosed antenna is easy to tune due to individual arms for high- and low-band resonance. The low-band antenna arm can be constructed of an appropriate length for the particular low-band frequency resonance desired. Similarly, the high-band antenna arm can be constructed of an appropriate length for the particular high-band frequency resonance desired. Thus, embodiments of the disclosed antenna provide the ability to vary high-impedance loci by manipulating the length of main and coupling antenna arms to avoid antenna coupling to other sensitive components near the antenna. Coupling methods allow element routing around grounded structures near the edge of the device, such as, for example, mini-USB connectors, with substantially minimal degradation. The disclosed antenna provides a balance between antenna size and bandwidth. Furthermore, in an embodiment, the disclosed antenna provides low insertion loss switching between high-band and low-band modes.

In an embodiment, a broadband switchable antenna includes an antenna feed; a high-band antenna arm comprising a first end electrically coupled to an antenna feed and a second end electrically coupled to ground; a switch coupled to the antenna feed at a position proximate to the first end of the high-band antenna arm; and a low-band antenna arm comprising a first end electrically coupled to the switch, wherein the antenna is configured to operate in a high-band mode when the switch is open and to operate in a low-band mode when the switch is closed. In an embodiment, the broadband switchable antenna includes a low-band antenna coupling arm connected to ground and separated from a second end of the low-band antenna arm by a small gap of non-electrically conducting material, such as a dielectric. In an embodiment, the second end of the high-band antenna connects to ground at a location nearer the antenna feed than a location where the low-band antenna arm is connected to ground. In an embodiment, the switch could be a single-pole double-throw (SPDT) complementary metal-oxide-semiconductor (CMOS) switch or a micro-electro-mechanical system (MEMS) switch. In an embodiment, the broadband switchable antenna includes a second switch coupled to the first switch; a second high-band antenna arm coupled to the second switch at a first end and to ground at a second end; and a second low-band antenna arm coupled to the switch, wherein the second high-band antenna arm is tuned to a different resonating frequency than the first high-band antenna arm, wherein the second low-band antenna arm is tuned to a different resonating frequency than the first low-band antenna arm, and wherein the first and second switches control to which resonating frequency the broadband switchable antenna is tuned.

In an embodiment, the antenna is included in a wireless handheld device, such as a wireless phone. In an embodiment, the wireless device includes a processor; and an antenna structure coupled to the processor, wherein the antenna structure comprises: an antenna feed; a high-band antenna arm comprising a first end electrically coupled to an antenna feed and a second end electrically coupled to ground; a switch coupled to the antenna feed proximate to the first end of the high-band antenna arm; and a low-band antenna arm comprising a first end electrically coupled to the switch, wherein the antenna is configured to operate in a high-band mode when the switch is open and to operate in a low-band mode when the switch is closed. In an embodiment, the second end of the high-band antenna connects to ground at a location nearer the antenna feed than a location where the low-band antenna arm is connected to ground. In an embodiment, the high-band antenna arm and the low-band antenna arm are a low profile structure, wherein the thickness of the low profile structure is less than or equal to about 3 millimeters. In an embodiment, the positions and the lengths of the high-band antenna arm and the low-band antenna arm are configured to situate high-impedance loci of the antenna structure in a manner such as to avoid antenna coupling to other components in the wireless device. Furthermore, in an embodiment, the positions and the lengths of the high-band antenna arm and the low-band antenna arm are configured to situate high-impedance loci of the antenna structure such as to avoid areas of user hand and head placement on the wireless device.

In an embodiment, an antenna includes a single antenna feed; a main antenna arm; multiple grounded coupling antenna arms coupling to multiple sections of the main antenna arm, and a switch comprising an open position and a short-circuited position, wherein the switch is coupled to the single antenna feed to control which of the main antenna arm and the multiple grounded coupling arms are coupled to the single antenna feed, wherein different resonating frequencies are tunable according to the position of the switch. In an embodiment, the multiple grounded coupling antenna arms include a short-arm antenna arm coupled nearer the main antenna arm than another arm of the antenna for high-band resonance FIG. 1 is a schematic diagram of an embodiment of a wireless user equipment (UE) 100 with a hybrid broadband switchable antenna. The UE 100 includes a main chassis 112, a radio frequency (RF) source/sink 102, a grounded universal serial bus (USB) port 108, a high-band resonating/coupling antenna arm 104, a low-band resonating main antenna arm 110, and a switch 106. The RF source/sink 102, the high-band resonating/coupling antenna arm 104, the low-band resonating main antenna arm 110, and the switch 106 form an antenna or antenna structure. The RF source/sink 102 functions as a source when the UE 100 is transmitting signals and as a sink when the UE 100 is receiving signals. In an embodiment, the switch 106 is a single-pole double-throw (SPDT) switch, or a microelectromechanical system (MEMS) switch. In other embodiment, other types of switches can be used. In an embodiment, the switch 106 is a SPDT complementary metal-oxide-semiconductor (CMOS) switch. The high-band resonating/coupling antenna arm 104 and the low-band resonating main antenna arm 110 may be constructed from any electrically conducting material, such as, for example, copper. The main chassis 112 provides a ground for the high-band resonating/coupling antenna arm 104 and the low-band resonating main antenna arm 110. In an embodiment, low-band frequencies are below 1000 MHz and high-band frequencies are greater than 1000 MHz. In an embodiment, the low-band frequencies are in the range of about 700 MHz to about 1000 MHz and the high-band frequencies are in the range from about 1400 MHz to about 2700 MHz. The high-band resonating/coupling antenna arm 104 and the low-band resonating main antenna arm 110 form a segmented loop. The antenna structure or antenna may be referred to as a hybrid antenna, a hybrid switchable antenna, or a hybrid broadband switchable antenna. The disclosed hybrid antenna includes attributes of an inverted-F antenna (IFA) and of a loop antenna and may operate like an IFA for low-band resonance when the switch 106 is closed and may operate like a segmented loop antenna for high-band resonance when the switch 106 is open. The switch 106 is connected to the RF source/sink 102 and is located at or near the end of the high-band resonating coupling antenna arm 104 and at or near the end of the low-band resonating main antenna arm 110.

The disclosed design allows the grounded USB 108 and a grounded speaker (not shown) to be extended to the extremities, center, or side of the UE 100 with substantially minimal degradation of performance. The grounded USB 108 can be close to, but does not touch the high-band resonating/coupling antenna arm 104 or the low-band resonating main antenna arm 110. In an embodiment, the grounded USB 108 is approximately 10 millimeters (mm) from the low-band resonating main antenna arm 110. The grounded USB 108 may lie in different planes from the plane in which the low-band resonating main antenna arm 110 lies, at least in the area near the grounded USB 108. This allows the grounded USB 108 to extend to the extremities of the UE 100 without contacting the antenna structure.

When the switch 106 is shorted (e.g., closed), the current flows through the low-band resonating main antenna arm 110 and couples to the board 112 resulting in a large capacitance. The high-band resonating antenna arm 104 provides just enough inductance to balance out the capacitance in the low-band resonating arm 110. Thus, in the shorted switch state, the antenna provides a low-band resonance with good impedance matching.

When the switch 106 is open, current flows mainly through the high-band resonating/coupling arm 104. The low-band resonating main antenna arm 110 provide just enough inductance to balance out the capacitance in the high-end resonating/coupling arm 104. The open switch state provides a high-band resonance with good impedance matching.

Figure 2:
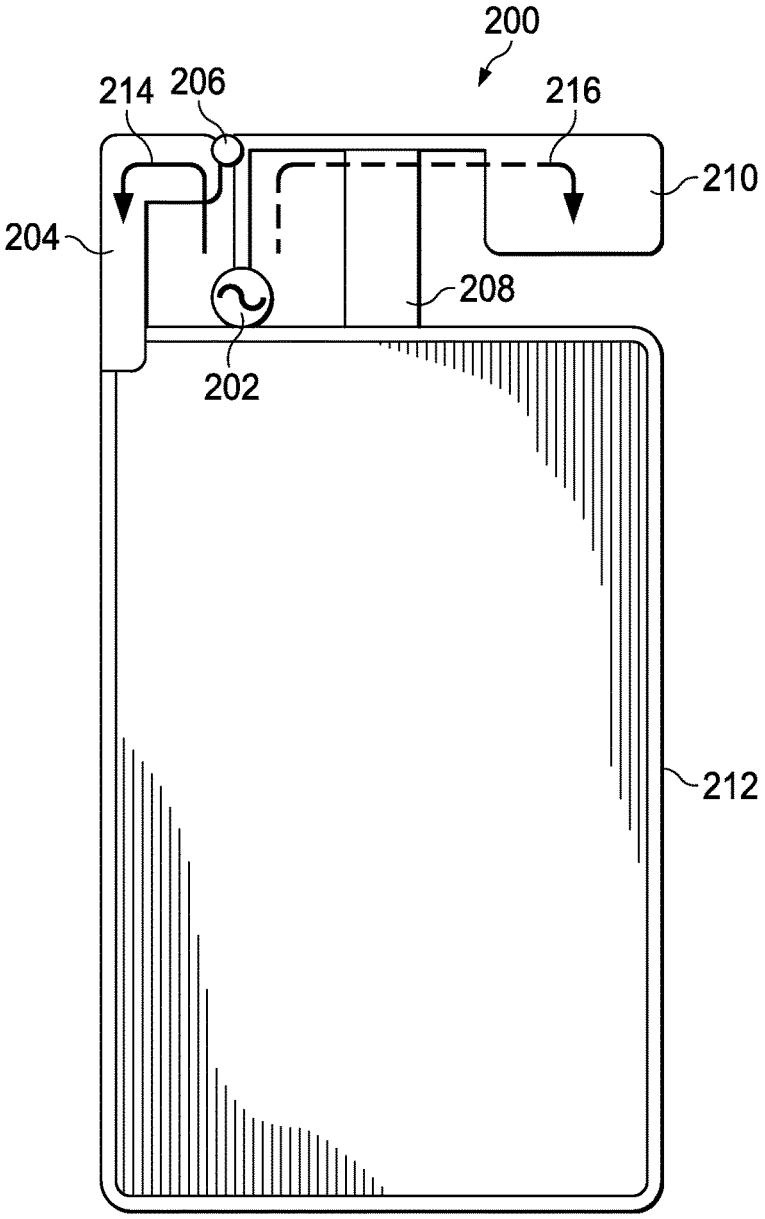
FIG. 2 is a schematic diagram of an embodiment wireless UE with a hybrid broadband switchable antenna.

FIG. 2 is a schematic diagram of an embodiment wireless UE 200 with a hybrid broadband switchable antenna. UE 200 may be similar to UE 100 depicted in FIG. 1 and may include similar components arranged in a similar manner as those in FIG. 1. UE 200 includes a main chassis 212, a RF source/sink 202, a grounded USB port 208, a high-band resonating/coupling antenna arm 204, a low-band resonating main antenna arm 210, and a switch 206. The main chassis 212, the RF source/sink 202, the grounded USB port 208, the high-band resonating/coupling antenna arm 204, the low-band resonating main antenna arm 210, and the switch 206 may be similar to respective ones of the main chassis 112, the RF source/sink 102, the grounded USB port 108, the high-band resonating/coupling antenna arm 104, the low-band resonating main antenna arm 110, and the switch 106 depicted in FIG. 1.

The high-band resonating/coupling antenna arm 204 determines the high-band resonance when the switch 206 is open (i.e., open-circuited) with good impedance matching. The current flows as indicated by arrow 214 in the open switch 206 situation forming a segmented loop resonance at the high-band. The low-band resonating main antenna arm 210 determines the low-band resonance when the switch 206 is short-circuited with good impedance matching. The current flows as indicated by arrow 216 when the switch 206 is closed (i.e., short-circuited). In an embodiment, just enough current flows through the inductive low-band resonating main antenna arm 210 to balance out the capacitive gap in the high-band resonating/coupling antenna arm 204. In an embodiment, the grounded USB 208 (and any speakers (not shown)) has little or no effect on the antenna. The disclosed UE 200 enables a low insertion loss switching method. For low-band operation, the switch 206 is closed/short-circuited. The low-band arm 210 is capacitive at low-band frequency, coupling to the ground plane 212 at the end, hence it requires the switch 206 to be closed, to provide an inductive shorted path to the ground plane 212, through shorted high-band arm 204. Hence the capacitance of the low-band arm 210 at low-band is balanced by the shorted switch 206 with the inductive high-band arm 204.

Figure 3:
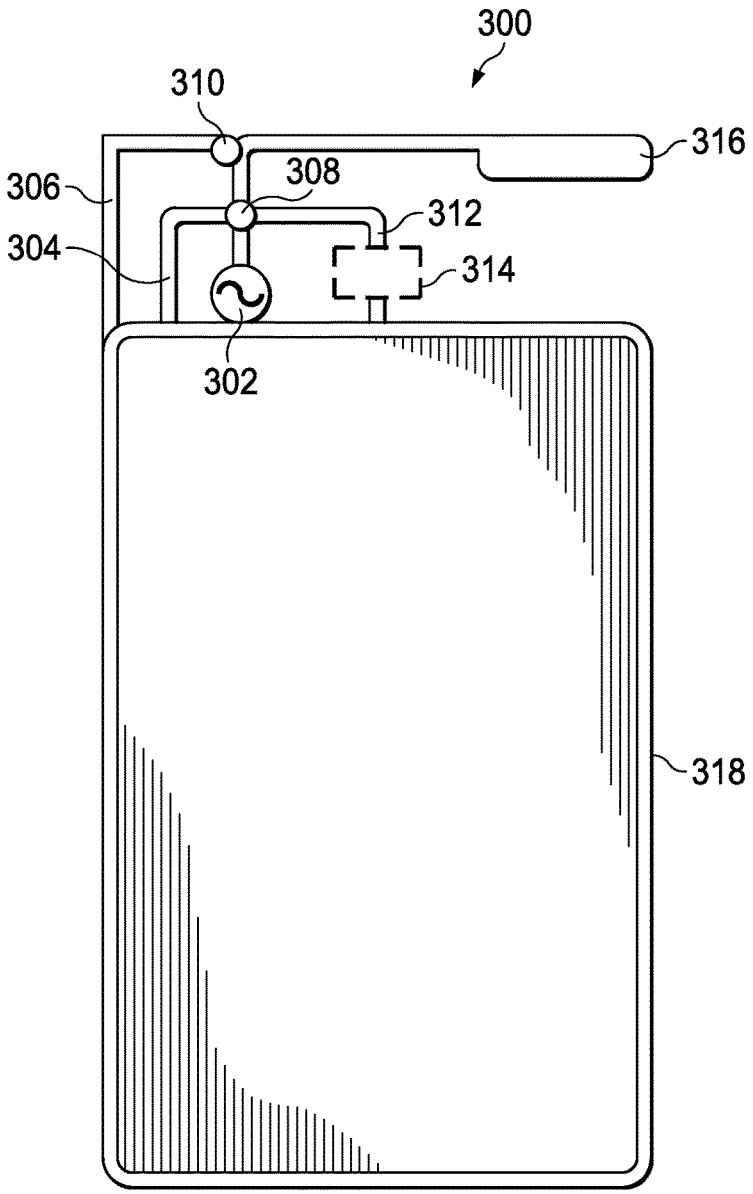
FIG. 3 is a schematic diagram of an embodiment wireless UE with a hybrid broadband switchable antenna.

FIG. 3 is a schematic diagram of an embodiment wireless UE 300 with a hybrid broadband switchable antenna. UE 300 includes an RF source/sink 302, a first high-band resonating/coupling arm 304, a second high-band resonating/coupling arm 306, a first low-band coupling antenna arm 312, a matching circuit 314, a main antenna arm 316, a first switch 308, a second switch 310, and a chassis 318. The elements of UE 300 may be similar to similar elements depicted in FIG. 1 or 2. UE 300 provides multiple switched coupling arms allowing the antenna to be switched between multiple broadband frequencies for both high and low bands. The first coupling antenna arm 312 with the matching circuit 314 (for impedance matching) provide a first low-band resonance when the first switch 308 is switch is shorted and the second switch 310 is open. A first high-band resonance is provided when the first switch is open and the second switch 310 is open. A second high-band resonance is provided when the first switch 308 is open and the second switch 310 is shorted. A second low-band resonance is provided when the first switch 308 is shorted and the second switch 310 is shorted. The smaller the loop enabled by the switches 308 and 310, the higher the resonating frequency supported by the antenna.

Figure 4A:
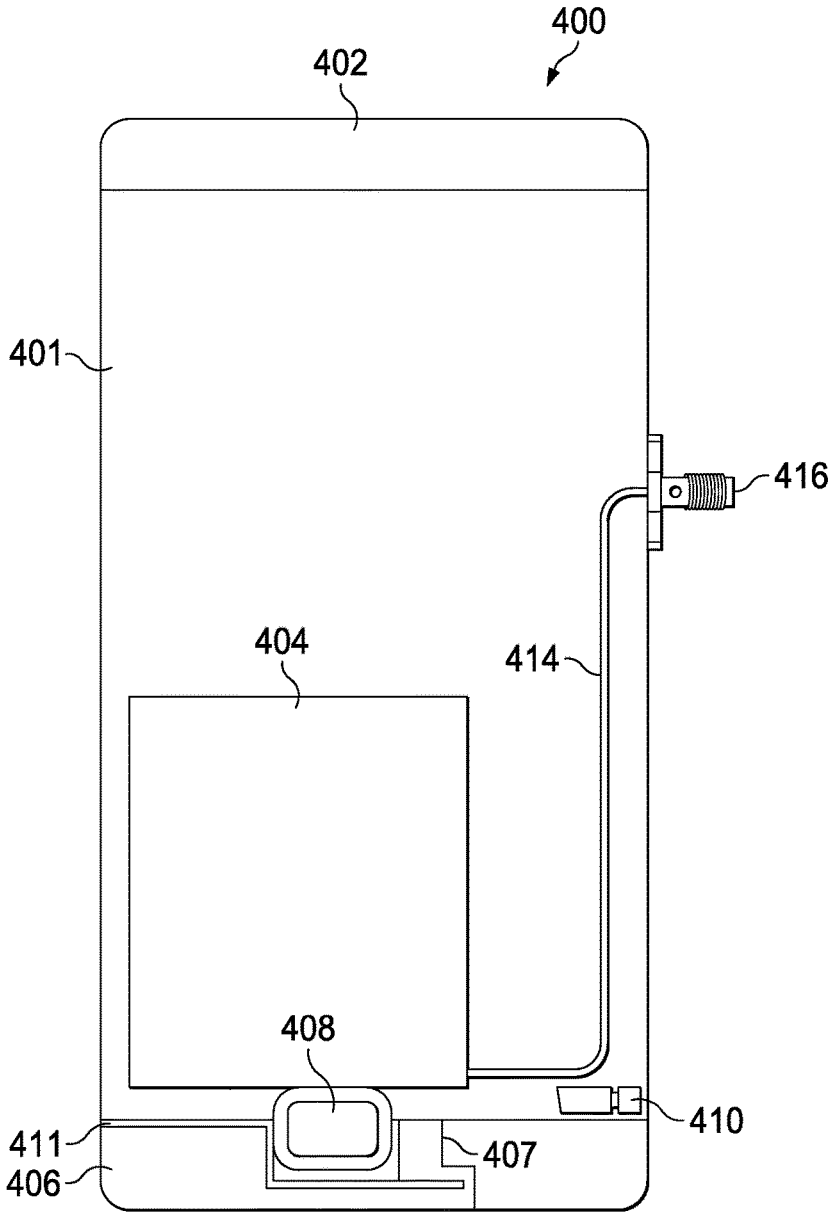
FIGS. 4A & 4B are physical layout diagrams of the back and front of a portion of an embodiment of a UE with a hybrid broadband switchable antenna.
Figure 4B:
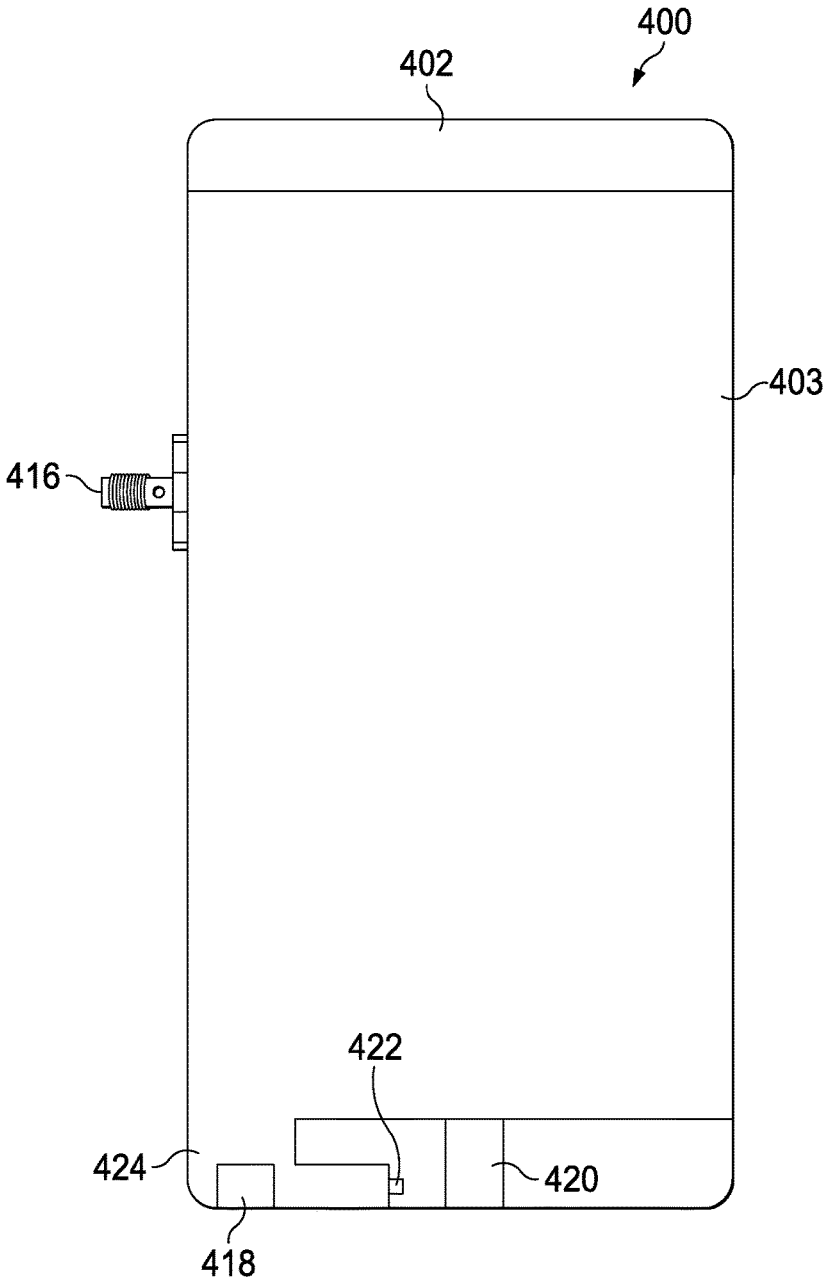

FIGS. 4A & 4B are physical layout diagrams of the back and front of a portion of an embodiment of a UE 400 with a hybrid broadband switchable antenna. UE 400 may be implemented as, for example, UE 100 depicted in FIG. 1. The back portion of the UE 400 is shown in FIG. 4A. The front portion of the UE 400 is shown in FIG. 4B. The back portion of the UE 400 includes a battery 404, an antenna feed 407 (i.e., RF source/sink—e.g., RF source/sink 102 in FIG. 1), a grounded speaker 408, a high-band resonating/coupling antenna arm 406, a co-axial cable 414 to transport the RF signal/energy into the antenna (in other embodiments, the signal is provided by a chip or other component in the UE 400), a SMA RF-connector 416 to connect another device to the UE 400 to deliver the RF power, a first grounded region 401, and a vibrator 410 connected on a non-electrically conducting substrate 402. A non-electrically conducting keep out region 411 separates the high-band resonating/coupling antenna arm 406 from a grounded region 401. In an embodiment, the keep out region 411 is about 70 mm by 10 mm. In an embodiment, the mounting board is about 70 mm wide, about 140 mm long, and about 3 mm thick. In an embodiment, the grounded region 401 is a solid piece of conductor, such as, for example, multi-layered copper.

The front portion of the UE 400 includes a second grounded region 403 mounted to the opposite side of the mounting board 402 from that of the first grounded region 401 and in electrical contact with the first grounded region 401 such that grounded region 401 and second grounded region 403 maintain the same grounded electrical potential. A first grounded mini-USB 418 and a second grounded mini-USB 420 are electrically connected to the second grounded region 403 and mounted on mounting board 402. A low-band resonating main antenna arm 406 is mounted to the front portion of the mounting board 401 and is electrically coupled to a switch 422 that connects the high-band resonating/coupling antenna arm 424 from the front side of the UE 400 to the low-band resonating main antenna arm 406 when the switch 422 is shorted (e.g., closed). In an embodiment, the switch 422 has dimensions on the order of 1 mm. In an embodiment, the switch 422 is a RF switch, e.g. SPDT CMOS switch. The high-band resonating/coupling antenna arm 424, the low-band resonating main antenna arm 406, and the first and second grounded regions 401, 403 are constructed from an electrically conducting material, such as, for example, copper.

Figure 5:
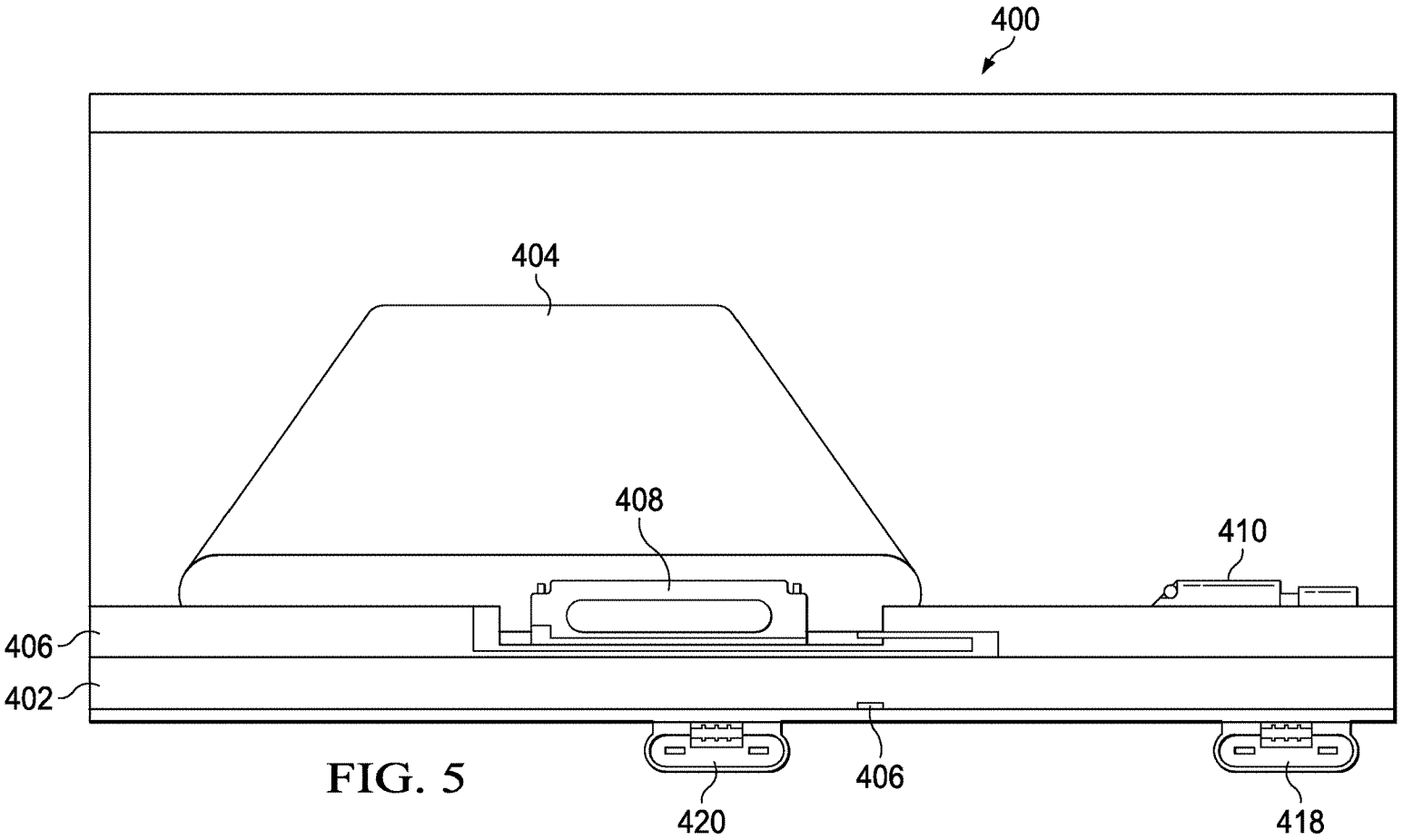
FIG. 5 shows a perspective view of the UE shown in FIGS. 4A & 4B.
Figure 6:
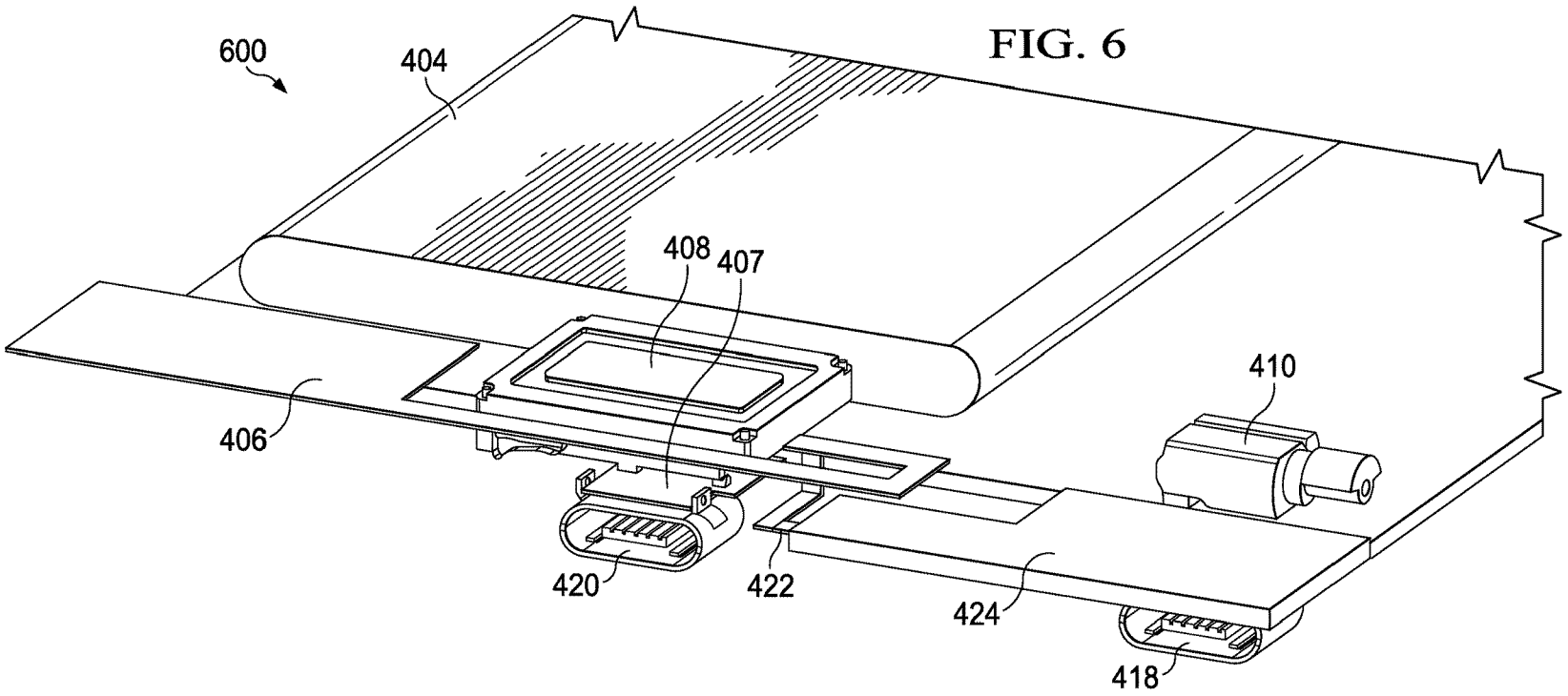
FIG. 6 shows a perspective view of one end of the UE 400 shown in FIGS. 4A & 4B.

FIG. 5 shows a perspective view of the UE 400 shown in FIGS. 4A & 4B. FIG. 6 shows a perspective view of one end of the UE 400 shown in FIGS. 4A & 4B.

Figure 7:
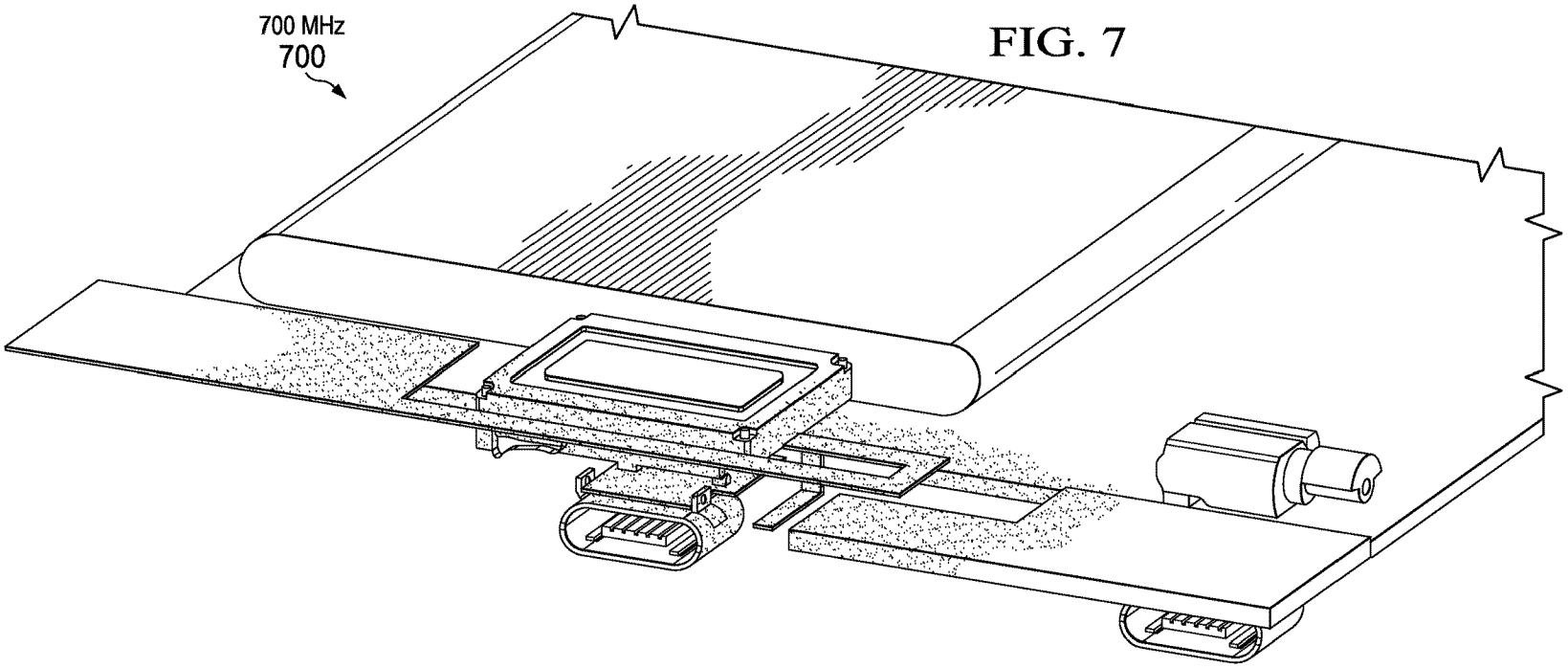
FIG. 7 shows a diagram illustrating areas of electrical activity of the antenna arms in a UE for 700 MHz resonance when the switch is closed.
Figure 8:
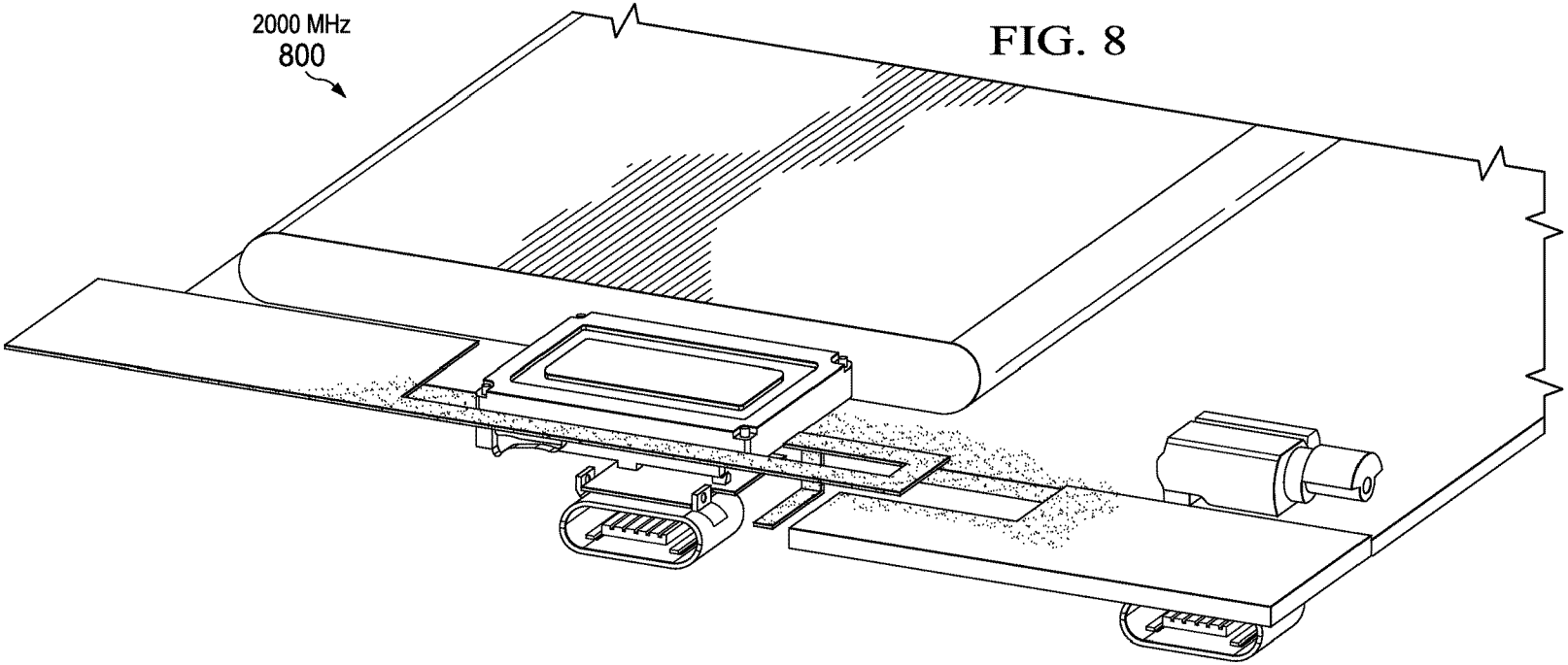
FIG. 8 shows a diagram illustrating areas of electrical activity of the antenna arms in a UE for 2000 MHz resonance when the switch is open.

FIG. 7 shows a diagram 700 illustrating areas of electrical activity 702 of the antenna arms 406 and 418 for 700 Mega Hertz (MHz) resonance when the switch 406 is closed. FIG. 8 shows a diagram 800 illustrating areas of electrical activity 802 of the antenna arms 406 and 418 for 2000 MHz resonance when the switch 406 is open. As can be seen with reference to FIGS. 7 and 8, there is little electrical activity in the low-band resonating main antenna arm 406 when the switch 422 is closed for the high-band case shown in FIG. 7 as compared to when the switch 422 is open for the low-band case as shown in FIG. 8.

Figure 9:
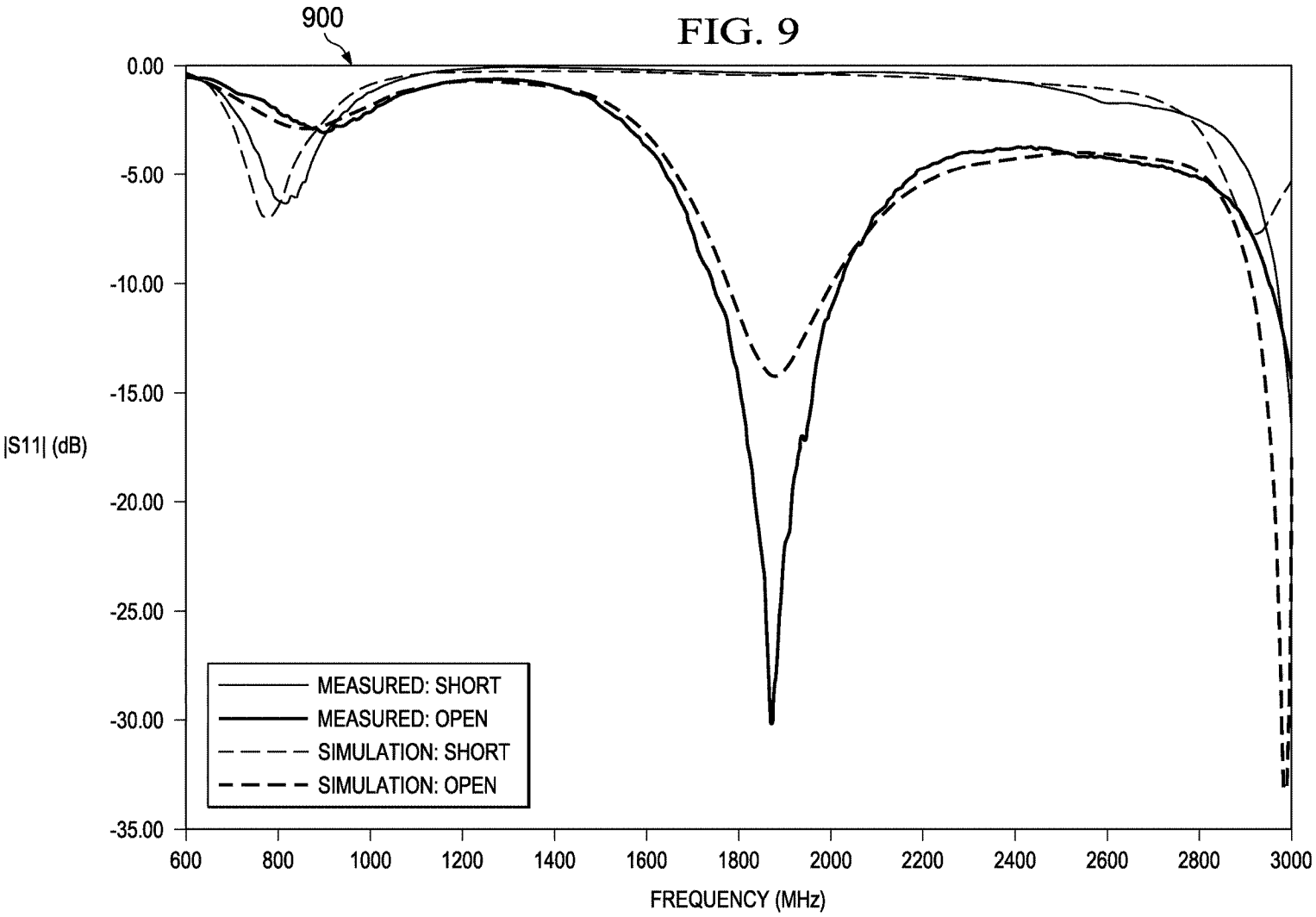
FIG. 9 shows a graph 900 illustrating the measured and simulated performance for both the switch in the open configuration and the switch in the closed configuration for UE 400.

FIG. 9 shows a graph 900 illustrating the measured and simulated performance for both the switch in the open configuration and the switch in the closed configuration for UE 400. As shown, the simulated and measured results show good agreement. The measured and simulated short performance shows good performance as indicated by the dip in the functions near 800 MHz. The measured and simulated open performance also shows good performance as indicated by the dip of the functions between 1800 and 2000 MHz.

Figure 10:
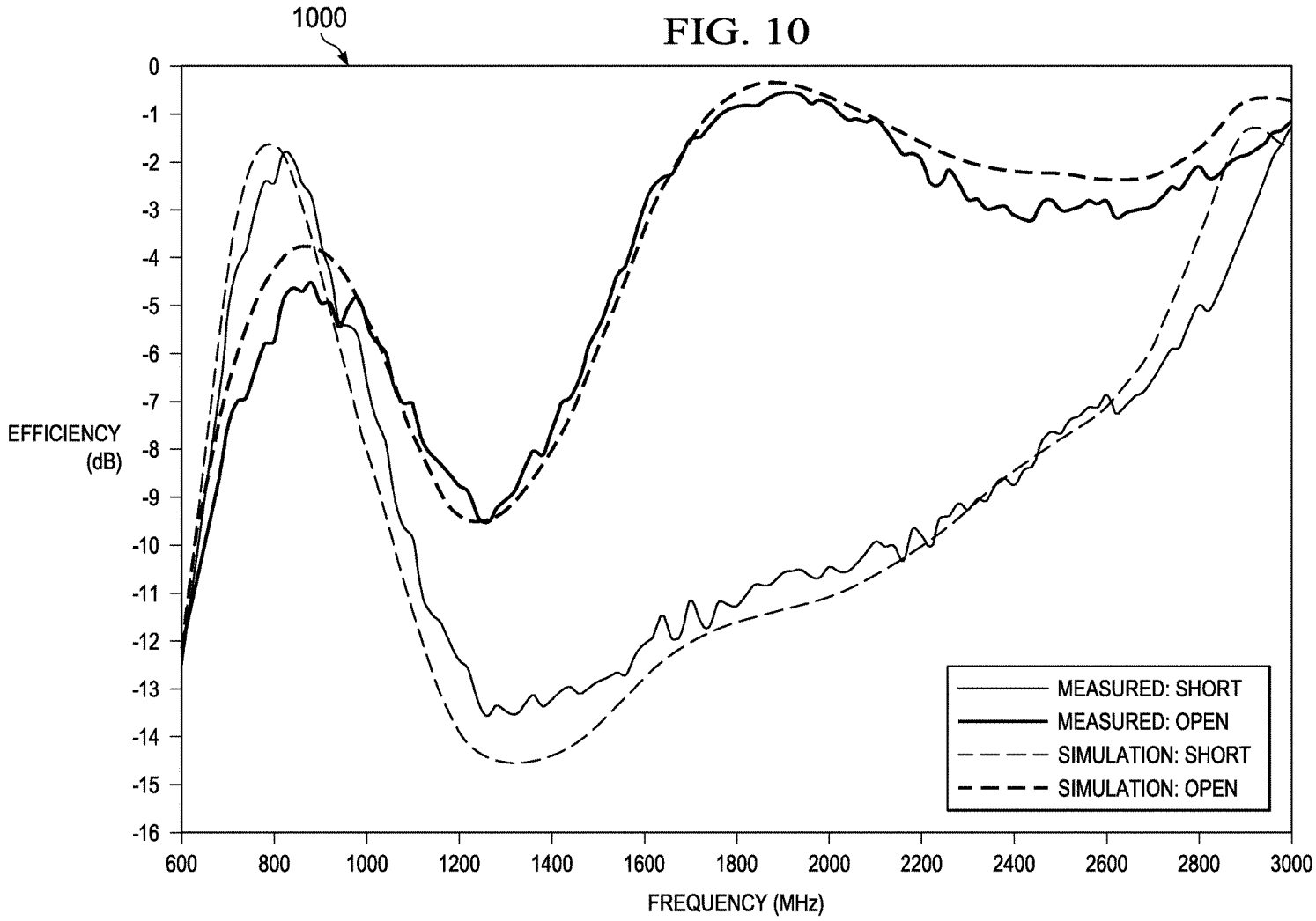
FIG. 10 shows a graph 1000 illustrating the efficiency of the antenna in UE 400 for simulated and measured results for both open and closed switches.

FIG. 10 shows a graph 1000 illustrating the efficiency of the antenna in UE 400 for simulated and measured results for both open and closed switches. As shown, the disclosed antenna for UE 400 has good efficiency near 800 MHz for the shorted or closed switch representing the low-band case. Also, the disclosed antenna for UE 400 has good efficiency between 1600 and 2200 MHz.

Figure 11:
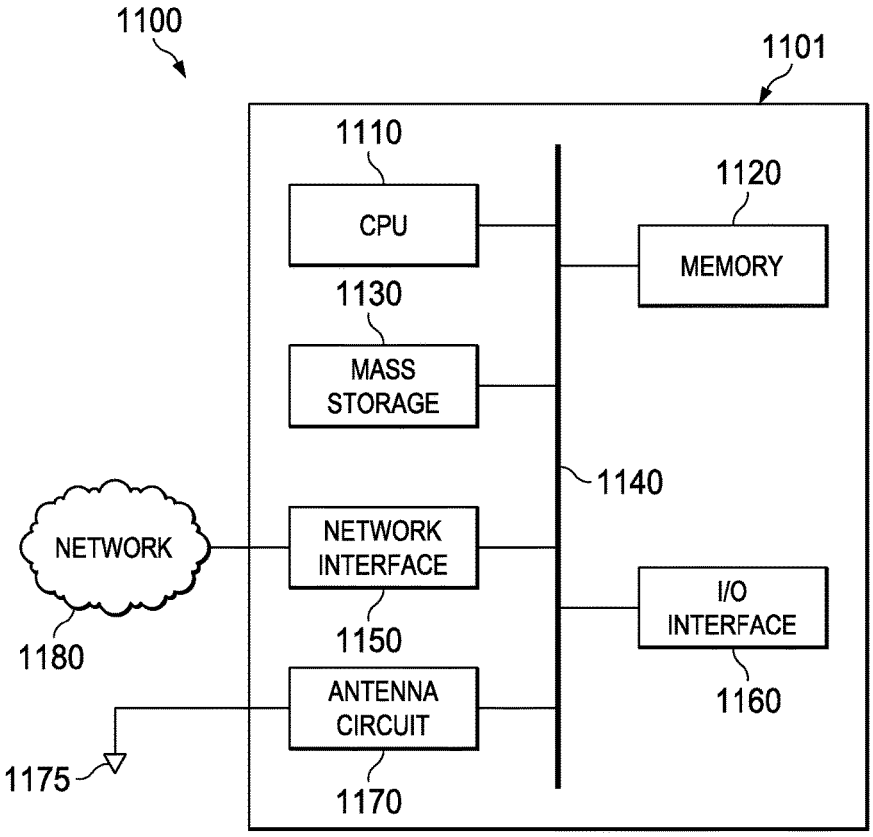
FIG. 11 is a processing system that can be used to implement various embodiments.

FIG. 11 is a block diagram of a processing system 1100 that may be used for implementing the devices and methods disclosed herein. Specific devices may utilize all of the components shown, or only a subset of the components and levels of integration may vary from device to device. Furthermore, a device may contain multiple instances of a component, such as multiple processing units, processors, memories, transmitters, receivers, etc. The processing system 1100 may comprise a processing unit 1101 equipped with one or more input/output devices, such as a speaker, microphone, mouse, touchscreen, keypad, keyboard, printer, display, and the like. The processing unit 1101 may include a central processing unit (CPU) 1110, memory 1120, a mass storage device 1130, a network interface 1150, an I/O interface 1160, and an antenna circuit 1170 connected to a bus 1140. The processing unit 1101 also includes an antenna element 1175 connected to the antenna circuit.

The bus 1140 may be one or more of any type of several bus architectures including a memory bus or memory controller, a peripheral bus, video bus, or the like. The CPU 1110 may comprise any type of electronic data processor. The memory 1120 may comprise any type of system memory such as static random access memory (SRAM), dynamic random access memory (DRAM), synchronous DRAM (SDRAM), read-only memory (ROM), a combination thereof, or the like. In an embodiment, the memory 1120 may include ROM for use at boot-up, and DRAM for program and data storage for use while executing programs.

The mass storage device 1130 may comprise any type of storage device configured to store data, programs, and other information and to make the data, programs, and other information accessible via the bus 1140. The mass storage device 1130 may comprise, for example, one or more of a solid state drive, hard disk drive, a magnetic disk drive, an optical disk drive, or the like.

The I/O interface 1160 may provide interfaces to couple external input and output devices to the processing unit 1101. The I/O interface 1160 may include a video adapter. Examples of input and output devices may include a display coupled to the video adapter and a mouse/keyboard/printer coupled to the I/O interface. Other devices may be coupled to the processing unit 1101 and additional or fewer interface cards may be utilized. For example, a serial interface such as Universal Serial Bus (USB) (not shown) may be used to provide an interface for a printer.

The antenna circuit 1170 and antenna element 1175 may allow the processing unit 1101 to communicate with remote units via a network. In an embodiment, the antenna circuit 1170 and antenna element 1175 provide access to a wireless wide area network (WAN) and/or to a cellular network, such as Long Term Evolution (LTE), Code Division Multiple Access (CDMA), Wideband CDMA (WCDMA), and Global System for Mobile Communications (GSM) networks. In some embodiments, the antenna circuit 1170 and antenna element 1175 may also provide BLUETOOTH and/or WI-FI connection to other devices.

The processing unit 1101 may also include one or more network interfaces 1150, which may comprise wired links, such as an Ethernet cable or the like, and/or wireless links to access nodes or different networks. The network interface 1101 allows the processing unit 1101 to communicate with remote units via the networks 1180. For example, the network interface 1150 may provide wireless communication via one or more transmitters/transmit antennas and one or more receivers/receive antennas. In an embodiment, the processing unit 1101 is coupled to a local-area network or a wide-area network for data processing and communications with remote devices, such as other processing units, the Internet, remote storage facilities, or the like.

Although the description has been described in detail, it should be understood that various changes, substitutions and alterations can be made without departing from the spirit and scope of this disclosure as defined by the appended claims. Moreover, the scope of the disclosure is not intended to be limited to the particular embodiments described herein, as one of ordinary skill in the art will readily appreciate from this disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed is:

1. A broadband switchable antenna comprising:

an antenna feed;

a switch comprising a first end and a second end;

a grounded coupling arm comprising a first end and a second end, wherein the first end of the grounded coupling arm is coupled to the first end of the switch and coupled to the antenna feed, and the second end of the grounded coupling arm is directly connected to ground, and wherein current flows mainly through the grounded coupling arm and the grounded coupling arm is an L-shaped high-band arm when the switch is open; and a main antenna arm comprising a first end and a second end, wherein the first end of the main antenna arm is directly connected to the antenna feed, the second end of the main antenna arm is not connected to the ground, wherein current flows through the main antenna arm that is a low-band arm when the switch is closed, and wherein the main antenna arm is not connected to the ground when the switch is open, wherein when the switch is closed, the grounded coupling arm is connected to the main antenna arm via the second end of the switch and the first end of the switch, and the antenna is configured to operate in a low-band mode, and wherein when the switch is open, the grounded coupling arm is disconnected from the main antenna arm, and the antenna is configured to operate in a high-band mode.

2. The broadband switchable antenna of claim 1, further comprising a low-band coupling arm directly connected to the ground and separated from the second end of the main antenna arm by a small gap of non-electrically conducting material.

3. The broadband switchable antenna of claim 2, wherein the non-electrically conducting material comprises a dielectric.

4. The broadband switchable antenna of claim 2, wherein the second end of the grounded coupling arm connects to the ground at a location nearer the antenna feed than a location where the low-band coupling arm is connected to the ground.

5. The broadband switchable antenna of claim 1, wherein the switch comprises a radio frequency (RF) switch.

6. The broadband switchable antenna of claim 5, wherein the RF switch comprises a single-pole double-throw (SPDT) complementary metal-oxide-semiconductor (CMOS) switch or a micro-electro-mechanical system (MEMS) switch.

7. A wireless device comprising:

a processor; and an antenna structure coupled to the processor, wherein the antenna structure comprises:

an antenna feed as a source when the antenna transmits a signal;

a switch comprising a first end and a second end;

a grounded coupling arm comprising a first end and a second end, wherein the first end of the grounded coupling arm is coupled to the first end of the switch and coupled to the antenna feed, and the second end of the grounded coupling arm is directly connected to ground, and wherein current flows mainly through the grounded coupling arm and the grounded coupling arm is an L-shaped high-band arm when the switch is open; and a main antenna arm comprising a first end and a second end, wherein the first end of the main antenna arm is directly connected to the antenna feed, the second end of the main antenna arm is not connected to the ground, and wherein current flows through the main antenna arm that is a low-band arm when the switch is closed, and wherein the main antenna arm is not connected to the ground when the switch is open, and wherein when the switch is closed, the grounded coupling arm is connected to the main antenna arm via the second end of the switch and the first end of the switch, and the antenna is configured to operate in a low-band mode, and wherein when the switch is open, the grounded coupling arm is disconnected from the main antenna arm, and the antenna is configured to operate in a high-band mode.

8. The wireless device of claim 7, further comprising a low-band coupling arm directly connected to the ground and separated from the second end of the main antenna arm by a small gap of non-electrically conducting material.

9. The wireless device of claim 8, wherein the second end of the grounded coupling arm connects to the ground at a location nearer the antenna feed than a location where the low-band coupling arm is connected to the ground.

10. The wireless device of claim 7, wherein the switch comprises a single-pole double-throw (SPDT) micro-electro-mechanical system (MEMS) switch.

11. The wireless device of claim 7, wherein the switch comprises a complementary metal-oxide-semiconductor (CMOS) switch.

12. The wireless device of claim 7, wherein the grounded coupling arm and the main antenna arm comprise a low profile structure, wherein a thickness of the low profile structure comprises less than or equal to about 3 millimeters.

13. The wireless device of claim 7, wherein positions and lengths of the grounded coupling arm and the main antenna arm are configured to situate high-impedance loci of the antenna structure away from electromagnetic components.

14. The wireless device of claim 7, wherein positions and lengths of the grounded coupling arm and the main antenna arm are configured to situate high-impedance loci of the antenna structure away from user's head or hand.

15. An antenna comprising:

a single antenna feed;

a main antenna arm is directly connected to the single antenna feed;

multiple switches;

multiple grounded coupling arms, wherein each of the multiple grounded coupling arms corresponds to one of the multiple switches and each of the multiple grounded coupling arms is an L-shaped arm, a first end of a first grounded coupling arm is coupled to a first end of a first switch, and a second end of the first grounded coupling arm is directly connected to ground, and wherein the first switch comprises an open position and a closed position, when the first switch is in the closed position, the first grounded coupling arm is connected to a section of the main antenna arm via a second end of the first switch and the first end of the first switch, wherein when the first switch is in the open position, the first grounded coupling arm is disconnected from the section of the main antenna arm, current flows through the first grounded coupling arm, the antenna is configured to operate in a high-band mode, and the first grounded coupling arm is an L-shaped high-band arm, and wherein different resonating frequencies are tunable according to the position of the first switch.

16. The antenna of claim 15, wherein the multiple grounded coupling arms comprise a short coupling arm and a long coupling arm, the short coupling arm being coupled closer to the main antenna arm than the long coupling arm being coupled to the main antenna arm.

17. The antenna of claim 15, wherein the first switch comprises a single-pole double-throw (SPDT) micro-electro-mechanical system (MEMS) switch.

18. The antenna of claim 15, wherein the first switch comprises a complementary metal-oxide-semiconductor (CMOS) switch.

19. The antenna of claim 15, wherein the multiple grounded coupling arms further comprise a second grounded coupling arm, and wherein the second grounded coupling arm is tuned to a different resonating frequency than the first grounded coupling arm.

* * * * *